United States Patent [19]

Danielson

[11] 3,939,925

[45] Feb. 24, 1976

[54] THROTTLE VALVE CONSTRUCTION FOR A PERCUSSION TOOL

[75] Inventor: Irvin R. Danielson, Burr Ridge, Ill.

[73] Assignee: Thor Power Tool Company, Aurora, Ill.

[22] Filed: Jan. 21, 1974

[21] Appl. No.: 435,328

[52] U.S. Cl. ..... 173/170; 173/18; 251/120

[51] Int. Cl.[2] ..... B25D 9/14

[58] Field of Search ..... 173/170, 18, 169; 251/120, 251/121, 122

[56] References Cited

UNITED STATES PATENTS

| | | | |
|---|---|---|---|
| 1,592,856 | 7/1926 | Jimerson | 173/18 |
| 2,001,487 | 5/1935 | Doherty | 251/14 |
| 2,400,207 | 5/1946 | O'Farrell et al. | 173/18 |
| 2,613,646 | 10/1952 | Gillerstrom | 173/170 |
| 3,038,446 | 6/1962 | O'Farrell | 173/170 |
| 3,373,824 | 3/1968 | Whitehouse | 173/169 |

*Primary Examiner*—Frank L. Abbott
*Assistant Examiner*—William F. Pate, III

[57] ABSTRACT

A throttle valve construction for a pneumatic paving breaker and other types of percussion tools employing a reciprocating piston to impart blows to a work steel or the like is disclosed, wherein partial movement of the control lever of the tool from a fully depressed position to a partially depressed position permits the throttle valve to shift to a position which substantially reduces the quantity of air under pressure being supplied to the operating cylinder of the tool so that the reciprocation frequency and kinetic energy of the piston are reduced. The amplitude and frequency of the vibrations generated by the tool and transmitted to the operator thereof are likewise substantially reduced when the tool is operating in this mode, and a significant reduction in the level of the sound emitted by the tool is also obtained.

10 Claims, 7 Drawing Figures

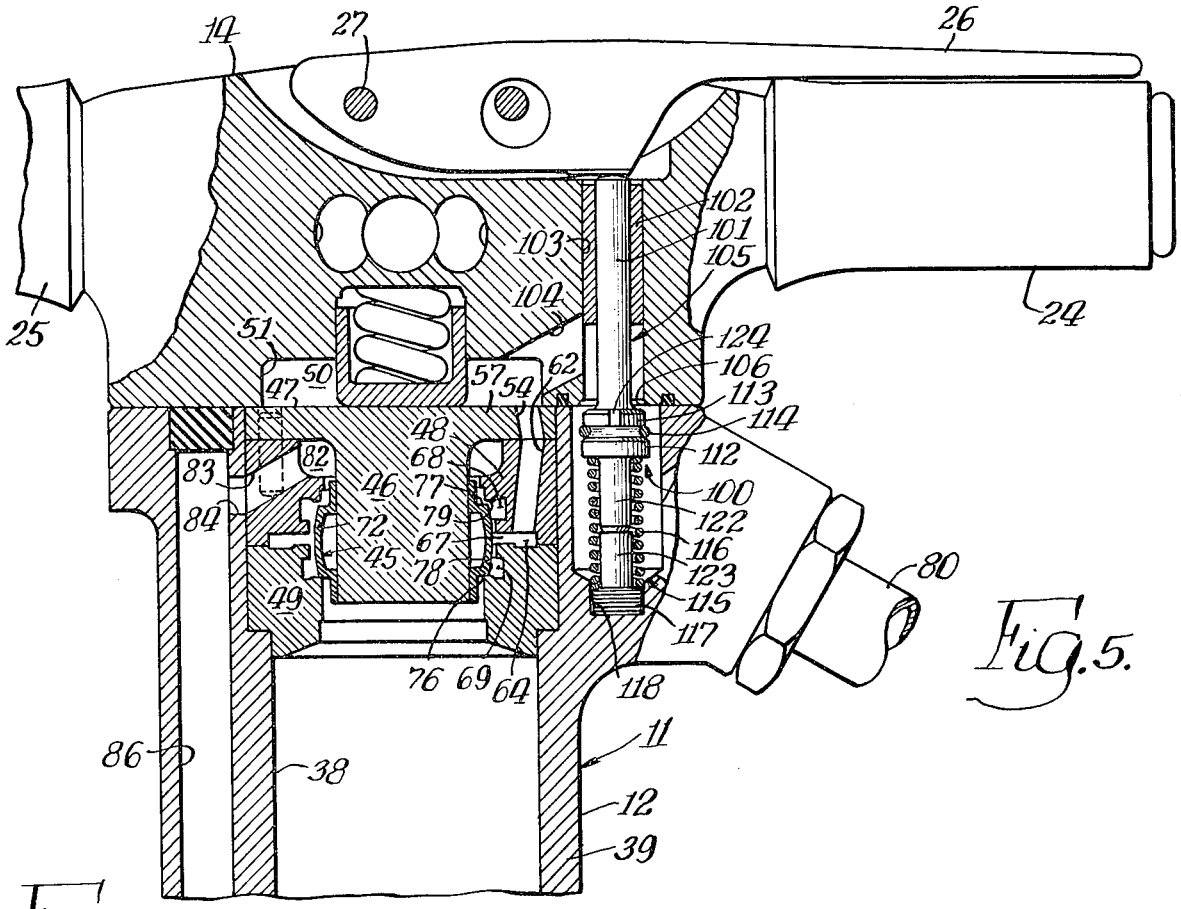
Fig. 5.
Fig. 6.
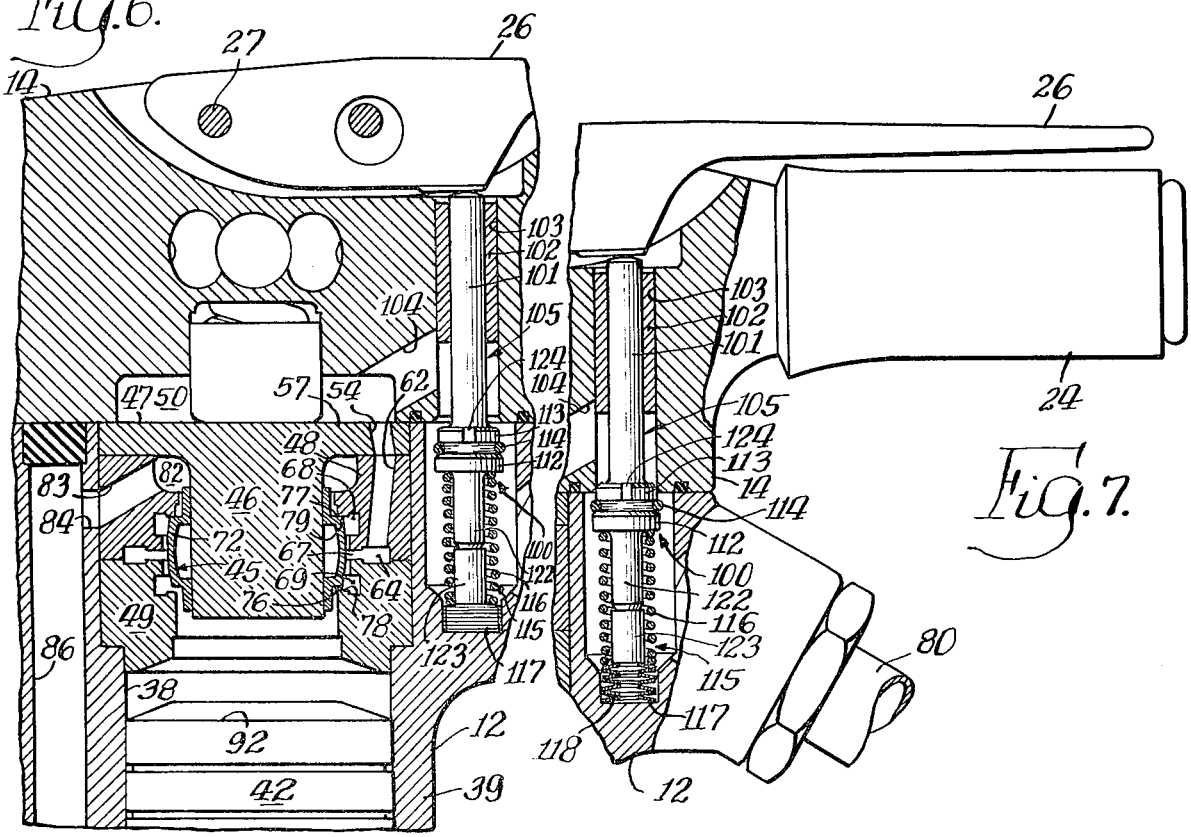
Fig. 7.

THROTTLE VALVE CONSTRUCTION FOR A PERCUSSION TOOL

This invention relates to percussion tools, and more particularly relates to a throttle valve construction for a pneumatic percussion tool, which substantially reduces the amplitude and frequency of vibration of the tool, as well as the sound level emitted thereby, when the tool is operated in a mode other than its normal working mode.

Manufacturers of percussion tools, such as pneumatic paving breakers and the like, have endeavored to reduce the amplitude and frequency of the vibrations transmitted to the operator of the tool when the latter is in use, and also to reduce the level of the sound emitted by the tool. As a result of this effort, the vibrations generated by many modern percussion tools are of substantially constant frequency and low amplitude, and thus can be tolerated by the operator for relatively long periods without fatigue. In addition, mufflers have also been employed to reduce the sound level of such tools to acceptable levels.

While many of the percussion tools presently in use are no longer objectionable either from an excess vibration or sound level standpoint while being used in a normal working mode, some tools, such as pneumatic paving breakers, are still objectionable for one or the other or both of the aforementioned reasons during the period when the tool is being withdrawn from a work area. The reason for this is that the operator of a paving breaker usually continues to hold the throttle lever of the tool closed while the tool is being withdrawn from the work. When this is done, the amplitude and frequency of the vibrations generated by the tool and transmitted to the operator become erratic and unsteady, and the tool is thus very difficult to control. In addition, the frequency and level of the sound emitted by the tool at this time increases, which is also objectionable.

Accordingly, it is a general object of the present invention to provide a novel percussion tool, particularly a pneumatic paving breaker, which is not subject to the aforementioned objections and disadvantages.

A more particular object is to provide a novel pneumatic paving breaker in which the vibration and sound levels of the tool are prevented from exceeding acceptable levels during the period when the work steel is being withdrawn from a work area and the tool is in operation.

A specific object is to provide a novel throttle valve construction for a pneumatic paving breaker, which throttles the supply of air entering the operating cylinder of the tool in response to partial movement of the throttle control lever of the tool toward its shut-off position so that the frequency and amplitude of vibration of the tool, as well as the sound level thereof, are substantially reduced.

Another object is to provide a novel throttle valve construction of the foregoing character, which incorporates a dual rate spring assembly to facilitate movement of the throttle valve to a position throttling the supply of air to the operating cylinder of the tool as a result of the change in shape of the operator's hands on the handles of the tool due to transition from pushing to pulling effort.

Other objects and advantages of the invention will become apparent from the following detailed description and accompanying sheets of drawings, wherein:

FIG. 5 is a fragmentary, longitudinal sectional view, with some parts in elevation, of the upper portion of the paving breaker illustrated in FIGS. 1 and 2 and showing the position of the parts thereof at start-up and before the automatically shiftable valve has moved to its upper position;

Figures 1, 2, 3, 4:
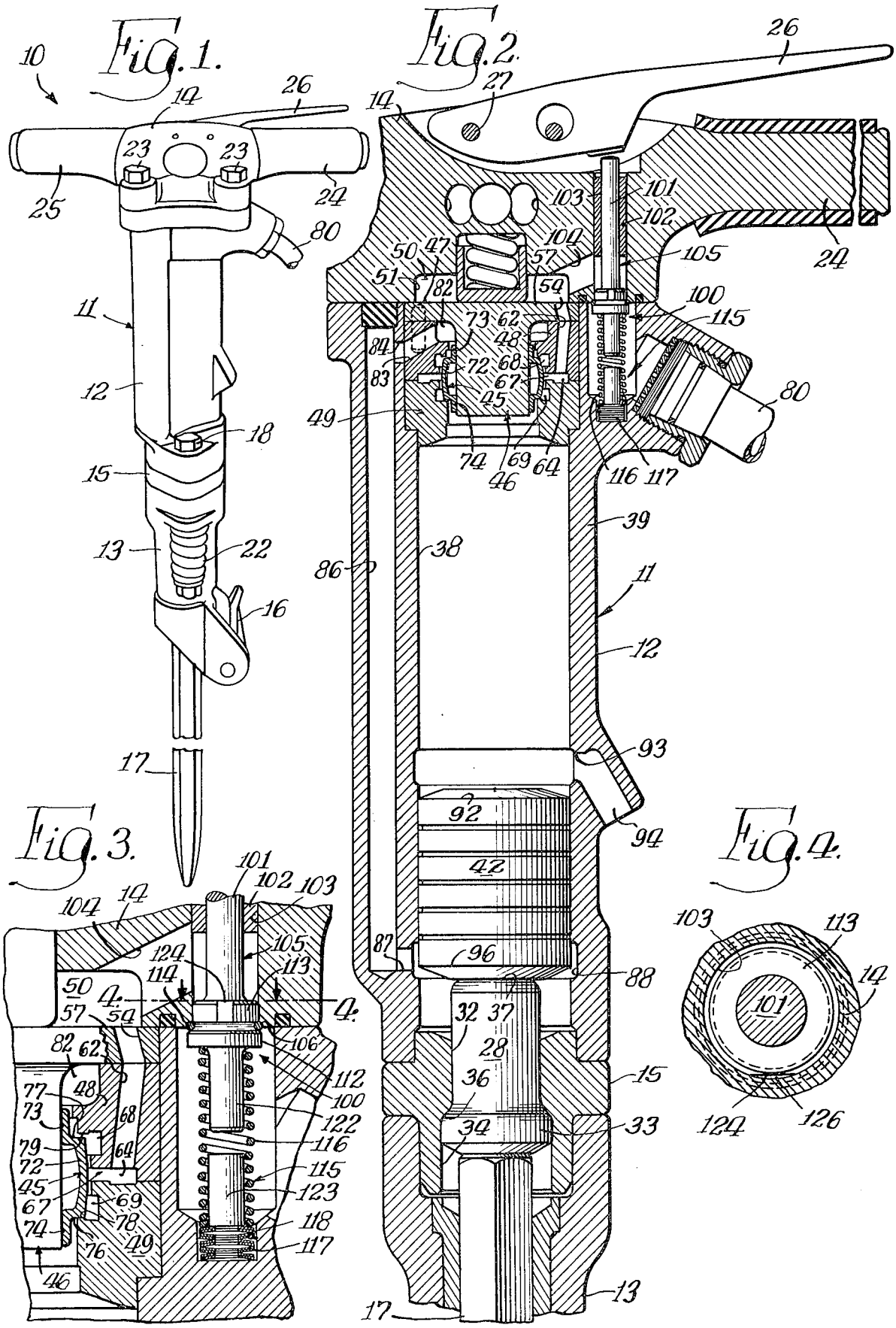
FIG. 1 is a perspective view, on a reduced scale, of a pneumatic paving breaker incorporating a throttle valve construction embodying the features of the present invention.
FIG. 2 is a somewhat enlarged, fragmentary, longitudinal sectional view through the upper portion of the paving breaker illustrated in FIG. 1.
FIG. 3 is a fragmentary sectional view, on a somewhat larger scale, showing additional details of the throttle valve construction illustrated in FIG. 2.
FIG. 4 is an enlarged cross-sectional view taken along the line 4–4 of FIG. 3.

FIG. 6 is a fragmentary, longitudinal sectional view, similar to FIG. 5, but showing the position of the parts of the paving breaker when the impact piston has reached the end of its upward stroke and is about to start its downward or impact stroke; and FIG. 7 is a fragmentary, longitudinal sectional view showing the throttle valve of the invention in the position it occupies when the paving breaker is operating at a reduced frequency, such as when the tool is being withdrawn from a work area.

In FIG. 1, a percussion tool, is the present instance a pneumatic paving breaker, is illustrated and indicated generally at 10. The paving breaker 10 is exemplary of one type of percussion tool with which the throttle valve construction of the present invention, to be hereinafter described in detail, is usable. The paving breaker 10 is conventional to the extent that it comprises an elongated tool body 11 which includes a cylinder assembly 12, a lower or front head assembly 13, and an upper or back head assembly 14. A tappet seat 15 is interposed between the cylinder assembly 12 and the front head assembly 13 and the latter is provided with latching structure 16 at the lower end thereof for releasably retaining a worksteel, such as a moil point 17, engaged herewith. A pair of elongated bolts, only one of which is shown in FIG. 1 and indicated at 18, extends through flanges on the lower and upper ends of the cylinder assembly 12 and front head assembly 13, as well as through the tappet seat 15, to maintain alignment between these parts, and a pair of coil springs, only one of which is shown in FIG. 1 and indicated at 22, bias the mating faces of the cylinder assembly 12, front head assembly 13 and tappet seat 15 into engagement but permit separation between the interfaces of these assemblies when the tool is in operation.

The upper or back head assembly 14 is secured to the upper end of the cylinder assembly 12 by four bolts, only two of which are shown in FIG. 1 and indicated at 23. The back head assembly 14 also includes a pair of laterally outwardly extending handles 24 and 25, and a throttle lever 26 is pivotally mounted in the back head assembly 14 as by a pin 27.

Referring now to FIG. 2 in conjunction with FIG. 1, it will be seen that a tappet 28 is slidably mounted in a bore 32 in the tappet seat 15 for axially shifting movement. The tappet 28 has a somewhat enlarged head 33 which is received in a counterbore 34 in the lower end of the tappet seat, the counterbore 34 defining a shoulder 36 in the tappet seat which limits upward movement of the tappet 28 therein. The upper end, indicated at 37, of the tappet 28 extends into the lower end of a bore 38 in the housing, indicated at 39, of the cylinder head assembly 12 so as to be in position to be engaged by and receive an impact blow from a piston 42 slidably mounted in the bore 38.

In order to cause the piston 42 to reciprocate in the cylinder bore 38, passage means is provided in the tool body 11 for communicating fluid under pressure, such as compressed air at 90 p.s.i., to the upper and lower ends of the cylinder 38, and an operating or control valve 45 is provided in the passage means for alternately directing the flow of compressed air to the upper and lower ends of the cylinder 38 each time the piston 42 approaches the end of its upward or downward stroke. To this end, the control valve 45 is shiftably mounted on the cylindrical portion 46 of a valve guide 47, which is mounted the upper end of the housing 39. The valve guide 47 is supported by an annular, upper or rear valve chest member 48 and the latter is supported by an annular, lower or front valve chest member 49. The valve chest members 48 and 49 surround the cylindrical portion 46 of the valve guide 47.

A chamber 50, provided by a recess 51 in the lower or inner end face of the back head assembly 14, communicates with a ring of generally axially extending bores, one of which is indicated at 54, in the flange portion, indicated at 57, of the valve guide 47 and with another ring of generally axially extending bores, one of which is indicated at 62, in the upper valve chest member 48. The lower ends of the bores 62 open into an annular chamber 64 defined between the upper valve chest member 48 and the lower valve chest member 49. An annular, radially extending passage 67 connects the chamber 64 with a pair of axially spaced, annular chambers 68 and 69, which surround a radially enlarged portion 72 of the operating valve 45.

As best seen in FIG. 3, the control valve 45 includes a pair of axially extending sleeve portions 73 and 74, which closely fit the exterior of the cylindrical portion 46 of the valve guide 47 and which define annular, radially extending sealing surfaces 76 and 77 at the lower and upper ends, respectively, of the radially enlarged portion 72. The sealing surfaces 76 and 77 coact with a corresponding pair of annular seats 78 and 79 on the lower and upper valve chest members 49 and 48, respectively. The seats 78 and 79 are axially spaced by a distance somewhat greater than the axial distance between the sealing surfaces 76 and 77 of the control valve 45 so that the radially enlarged portion 72 of the valve 45 can shift upwardly and downwardly between the seats 78 and 79.

Referring now to FIG. 5 in conjunction with FIG. 2, it will be assumed that the throttle lever 26 has been moved to its fully depressed position shown in FIG. 5 so that air at line pressure is free to flow from an inlet fitting 80, threaded into the upper end of the housing 39, past a throttle valve means 100, which embodies the features of the present invention and which will be described more fully hereinafter, into the chamber 50. It will further be assumed that the control valve 45 is in its lower position shown in FIGS. 2 and 5 so that sealing surface 76 is engaged with the annular seat 78. With the foregoing conditions, air under pressure in the chamber 69 is prevented from flowing into the upper end of the cylinder bore 38. However, air under pressure in the chamber 68 is free to flow through the gap between the sealing surface 77 and the annular seat 79 into an annular chamber 82 surrounding the cylindrical portion 46 of the valve guide 57. Air under pressure in the chamber 82 thus flows through a diagonally extending bore 83 in the upper valve chest member 48 and thence through a lateral bore 84 in the upper end of the housing 39 to enter the upper end of an axially extending bore 86.

The lower end of the axial bore 86 intersects another lateral bore 87 in the side wall of the housing 39, and the inner end of the bore 87 intersects a shallow groove 88 in the lower end of the cylinder bore 38 to thus connect the lower end of the cylinder bore 38 with air at line pressure in the annular chamber 68. Consequently, the piston 42 will be caused to move rapidly upwardly in the bore 38 toward the lower valve chest member 49.

As the piston 42 begins to move upwardly in the bore 38, air in the cylinder above the piston will be compressed. No substantial compression occurs, however, until the upper full diameter edge, indicated at 92, moves past and closes the inner end, indicated at 93 (FIG. 2), of at least one and preferably a plurality of exhaust ports 94 in the side wall of the cylinder housing 39.

As the lower, full diameter edge, indicated at 96, of the piston moves beyond the inner ends 93 of the exhaust ports 94, the pressure in the cylinder bore below the piston 42, and hence in the annular chamber 82, begins to drop since the chamber 82 is then connected by axial passage 86 and other bores and passages in the housing 39 with the exhaust ports 94. Consequently, as the piston 42 approaches the upper end of its stroke, the pressure in the cylinder above the piston will reach a value sufficient to cause the control valve 45 to shift from its lower position shown in FIGS. 2, 3 and 5 to its upper position shown in FIG. 6. When this occurs, communication between the chambers 68 and 82 is cut off and communication is established between the annular chamber 69 and the upper end of the cylinder bore 38. Upward movement of the piston 42 is arrested primarily, however, by the pressure of the air in the cylinder 38 above the piston, which is substantially greater than line pressure due to compressive action of the piston. The piston 42 will stop its upward movement and begin to move downwardly in its bore 38 before engaging the lower surface of the lower valve chest member 49. The approximate point at which the piston 42 changes direction is illustrated in FIG. 6.

With the control valve 45 in upper position illustrated in FIG. 6, air at line pressure will flow into the cylinder bore 38 above the piston 42 as the latter moves downwardly toward the tappet 28. The piston is thus accelerated toward the tappet until the lower, full diameter edge 96 thereof moves across and closes the inner ends 93 of the exhaust ports 94. When this occurs, pressure in the cylinder bore 38 below the piston 42 begins to increase. Such pressure increase is also communicated through the axial passage 86 to the chamber 82 and consequently to the upper end of the control valve 45.

When the upper, full diameter edge 92 of the piston 42 moves across the inner ends 93 of the ports 94, the pressure in the cylinder bore 38 above the piston begins to drop. Consequently, sometime before the piston 42 reaches the bottom of its downward stroke and impacts against the tappet 28, the pressure in the chamber 82 acting on the upper end of the control valve 45 will exceed line pressure and cause the valve to shift downwardly to the position thereof illustrated in FIGS. 2, 3, and 5. When this occurs, communication is re-established between the chambers 68 and 82 so that air at line pressure may then flow into the chamber 82 and continue to hold the control valve 45 in lower position. However, since the pressure in the cylinder 38 below the piston 42 is substantially greater than line pressure at this time, some back flow occurs through the bore 86 to the chamber 82. The pressure force opposing downward movement of the piston 42 is far less than the inertia force of the piston so that the latter continues to move downwardly and impact against the upper end 37 of the tappet 28. Consequently, an impact blow is applied to the upper end of the steel 17 and hence to the work with which the lower end of the steel is engaged. After the energy of the piston 42 has been expended, the piston will rebound upwardly and will continue to rise in the bore 38 with the assistance of air at line pressure, which is now flowing through the bore 87 and into cylinder 38 below the piston 42, for another cycle operation. The piston 42 will reciprocate continuously in the cylinder bore 38 and impart impact blows to the tappet 28 so long as air at line pressure is supplied to the chamber 50.

Referring now to FIGS. 2 and 3, the construction of the throttle valve means 100 will now be described. As will be apparent from these figures, the throttle valve means 100 comprises an elongated throttle valve member 105 and spring means in the form of a dual rate spring pack 115. The throttle valve member 105 includes an elongated stem or guide portion 101 that is shiftably mounted in a bushing 102 pressed into or otherwise secured in an axial bore 103 in the upper or back head assembly 14. A bore 104, comprising a portion of the passage means in the tool body 11, extends diagonally upwardly from the chamber 50 and intersects the bushing bore 103 below the lower edge of the bushing 102. The margin of the bore 103 in the end face of the back head 14 may be chamfered as at 106 to provide a sealing surface or seat.

The lower end of the stem 101 is enlarged to provide an annular closure portion 112 and an annular flow restricting portion 113 on the throttle valve member 105, the closure portion 112 being of somewhat greater diameter than the diameter of the bushing bore 103 and the flow restricting portion 113 being disposed above the portion 112 as viewed in FIGS. 2 and 3 and having a diameter substantially equal to the diameter of the bushing bore 103. An O-ring 114, or some other appropriate seal, is mounted in a groove between the portions 112 and 113 for engaging the seat 106 and preventing air at line pressure from flowing past the throttle valve member 105 when the latter is in its first or closed position illustrated in FIGS. 2 and 3.

The spring pack 115 of the throttle valve means 100 biases the throttle valve member 105 upwardly or toward the seat 106 and, in the present instance, includes a compression coil spring 116 and a stack of Belleville washers 117. The upper end of the coil spring 116 engages the lower or inner end face of the closure portion 112 and the lower end of the coil spring bears against the upper washer of the Belleville stack 117. The Belleville washers 117 are received in a bore 118 in the housing 39, coaxial with the bushing bore 103.

A cylindrical spring retainer 122 is provided on the lower end face of the closure portion 112 and extends into the upper coils of the spring 116. The lower end of the spring retainer 122 is adapted to engage the upper end of a spacer 123 which is disposed between the lower coils of the spring 116 and which rests on the stack of Belleville washers 117. The spacer 123 has a length such that the lower end of the guide portion 122 will engage the upper end of the spacer 123 substantially at the same time that the upper edge of the flow restricting portion 113 of the throttle valve member 105 moves out of the lower end of the bushing bore 103, as shown in FIG. 7.

As best seen in FIGS. 3 and 4, the flow restricting portion 113 includes a flat 124, which defines a gap 126 between the outer surface of the portion 113 and the inner surface of the bushing bore 103. The gap 126 comprises orifice means for substantially restricting the quantity of air which can flow past the throttle valve member 105 and through the passages in the tool body when the throttle valve member is partially open. The purpose and function of the gap 126 will be described in conjunction with the operation of the throttle valve means 100, which is as follows.

Assuming that the tool 10 has been moved into position over a work area by the operator with the work-steel of the tool, such as the moil point 17, engaged with the work, and further assuming that air at line pressure is available at the inlet fitting 80, the tool is brought into operation when the operator depresses the throttle lever 26 downwardly to the position thereof illustrated in FIGS. 5 and 6. Movement of the throttle lever 26 from the position thereof shown in FIG. 2 to the position shown in FIG. 5 shifts the throttle valve member 105 downwardly from its first or shut-off position to a second position wherein the O-ring seal 114 is spaced from the seat 106 and the flow restricting portion 113 is completely out of the lower end of the bore 103. Consequently, a substantially unrestricted flow path is established for air at line pressure to flow around the throttle valve member 105 and into the air supply passages of the tool 10. The piston 42 will then begin to reciprocate in its bore 38, as previously described, and impart impact blows to the work steel 17. It should be noted that when the throttle valve member 105 is in its second or normal operating position, the latter will be biased toward its closed position by the combined force of the coil spring 116 and Belleville washers 17, which force is relatively strong.

Assuming that the work steel 17 has penetrated into the work area a desired distance and that the operator has decided to terminate the breaking operation and withdraw the steel from the work to place it in a new location, he will then pull upwardly on the handles 24 and 25 and perhaps rock the tool 10 to free the steel. In so doing, the contours of the operator's hand will change and permit the lever 26 to pivot upwardly away from its fully depressed position shown in FIG. 5 to a partially depressed position shown in FIG. 7. Consequently the throttle valve member 105 will shift upwardly from its second or normal operating position shown in FIGS. 5 and 6 to a third or flow restricting position shown in FIG. 7 where at least a portion of the flow restricting portion 113 is positioned in the bore 103.

When the flow restricting portion 113 of the throttle valve member 105 is engaged in the bushing bore 103, the flow of the air into the supply passages of the tool 10 is substantially reduced. Such throttling action results from the fact that all the air must flow through the small gap 126 provided by the flat 124 on the outer surface of the flow restricting portion 113. The reduced air flow through the passages of the tool 10 causes a substantial reduction in the reciprocation frequency and kinetic energy of the piston 42. Consequently, the magnitude and frequency of the vibrations transmitted to the operator through the handles 24 and 25 of the tool are substantially reduced, as is the sound level thereof.

In this regard, tests have shown that the sound level emitted by a pneumatic paving breaker employing a throttle valve assembly constructed in the manner of throttle valve means 100 have a sound level of about 91 dBA when the tool is being withdrawn from the work and the throttle valve is in the throttling position illustrated in FIG. 7. This sound level is to be contrasted with a sound level of about 100 dBA which is obtained when a standard paving breaker is being withdrawn from the work area with the throttle valve fully open.

If the paving breaker 10 is equipped with a muffler such as is disclosed and claimed in the Douglas Bennett U.S. patent application Ser. No. 311,760, filed Dec. 4, 1973, now U.S. Pat. No. 3,815,705 and if the work steel 17 is equipped with a sound attenuating device such as is disclosed and claimed in the Danielson U.S. Pat. No. 3,783,970, issued Jan. 8, 1974, the sound level generated by the breaker while entering a work area is about 91 dBA and a sound level of about 79 dBA is obtained when the tool is being withdrawn from the work area and the throttle valve is restricting the flow of air through the passages of the tool.

While only one embodiment of the invention has been herein illustrated and described, it will be understood that modifications and variations thereof may be effected without departing from the scope of the invention as set forth in the appended claims.

I claim:

1. In a percussion tool including an elongated tool body having a cylinder therein and handle means at one end of said body for manipulating said tool, a piston mounted in said cylinder for reciprocating movement and operable to impart impact blows to a workpiece or the like mounted in one end of said body, said tool body also having passage means therein for conveying fluid under pressure to the opposite ends of said cylinder and control valve means for controlling the direction of the flow of fluid under pressure through said passage means so as to effect reciprocation of said piston in said cylinder, the improvement of throttle valve means including a throttle valve member adapted to be operatively connected to said passage means for controlling the quantity of fluid under pressure flowing therethrough, said throttle valve member having a first position preventing fluid flow through said passage means and into said cylinder to prevent operation of said tool, a second position permitting substantially unrestricted fluid flow through said passage means to permit normal operation of said tool, and a third position restricting the flow of fluid under pressure through said passage means so that the frequency of reciprocation and kinetic energy of said piston are substantially reduced, lever means mounted on said body adjacent to said handle means, said lever means being pivotal about an axis perpendicular to tool movement and operable to move said throttle valve member to said first, second and third positions, said lever means being positioned so as to hold said throttle valve member in said second position when said lever means is fully depressed by the operator, and said lever means also being positioned so as to permit movement of said throttle valve member to and to hold the same in said third position when a pulling force is applied to said handle means by the operator, whereby the magnitude and frequency of the vibrations generated by said tool and transferred to the operator thereof, and the operating noise level of the tool, when said throttle valve member is in said third position, are substantially less than when said throttle valve member is in said second position, said throttle valve member having a constant flow area for a substantial length of movement thereof adjacent said third position.

2. The percussion tool of claim 1, in which said passage means includes a seat and said throttle valve member includes a closure portion movable toward and away from said seat, said throttle valve member being disposed in said first position when said closure portion is engaged with said seat and in said second position when said closure portion is spaced a predetermined distance from said seat.

3. The percussion tool of claim 2, in which said throttle valve member includes orifice means for restricting fluid flow through said passage means, said orifice means being rendered operable to restrict fluid flow through said passage means when said closure portion is spaced from said seat by a distance less than said predetermined distance.

4. The percussion tool of claim 3, in which said throttle valve member includes a flow restricting portion adjacent to said closure portion and sized to closely fit a portion of said passage means adjacent to said seat, and said orifice means comprises a clearance space between said flow restricting portion and said portion of said passage means.

5. The percussion tool of claim 4, in which said portion of said passage means adjacent to said seat and said flow restricting portion of said valve member are circular in cross section, and said clearance space is provided by a flat on said flow restricting portion.

6. The percussion tool of claim 2, in which said handle means includes at least one laterally extending handle at the end of said tool body opposite from said workpiece receiving end, said lever means comprises a manually operable lever pivotally mounted on said body with the free end thereof overlyng said handle, and said throttle valve member includes a stem portion adapted to engage and effect movement of said throttle valve member to said second and third positions.

7. The percussion tool of claim 6, in which said throttle valve means includes spring means for biasing said throttle valve member toward said first position.

8. The percussion tool of claim 7, in which said spring means has a dual rate such that the force biasing said throttle valve member toward said first position is substantially greater when said throttle valve member is in said second position than when said throttle valve member is in said third position.

9. The percussion tool of claim 8, in which said spring means comprises a first spring member which acts on said throttle valve member when the latter is in said first, second and third positions, and a second spring member which acts on said throttle valve member only when the latter is in said second position.

10. The percussion tool of claim 9, in which said first spring means comprises a coil spring and said second spring member comprises at least one Belleville washer.

* * * * *